United States Patent [19]

Gidlund

[11] 4,388,972

[45] Jun. 21, 1983

[54] VIBRATIONLESS IMPACT TOOL

[75] Inventor: Per A. L. Gidlund, Täby, Sweden

[73] Assignee: Atlas Copco Aktiebolag, Nacka, Sweden

[21] Appl. No.: 256,148

[22] Filed: Apr. 21, 1981

[30] Foreign Application Priority Data

Apr. 25, 1980 [SE] Sweden ..... 8003177

[51] Int. Cl.[3] ..... B25D 17/24

[52] U.S. Cl. ..... 173/162 R; 92/85 A; 92/85 B; 267/137

[58] Field of Search ..... 173/18, 134, 139, 162 R, 173/162 H, 169; 92/85 A, 85 B, 143; 267/8 R, 34, 137

[56] References Cited

U.S. PATENT DOCUMENTS

| | | | |
|---|---|---|---|
| 1,804,712 | 5/1931 | Stevens | 173/162 |
| 3,010,431 | 11/1961 | Holdo | 173/162 |
| 3,245,483 | 4/1966 | Etzkorn | 173/169 X |
| 3,255,832 | 6/1966 | Leavell | 173/162 X |
| 3,727,700 | 4/1973 | Amtsberg | 173/18 |
| 3,920,086 | 11/1975 | Goppen et al. | 173/139 X |
| 4,308,926 | 1/1982 | Montabert | 173/139 X |

*Primary Examiner*—James L. Jones, Jr.
*Assistant Examiner*—Robert P. Olszewski
*Attorney, Agent, or Firm*—Frishauf, Holtz, Goodman & Woodward

[57] ABSTRACT

A vibrationless pneumatic impact tool comprises: a housing; a cylinder axially displaceable in the housing; a hammer piston reciprocably driven by pressure air in the cylinder; a recoil cushioning air volume disposed between the housing and the cylinder; a first valve arrangement located in a fixed disposition relative to the housing; and a second valve arrangement located in a fixed disposition relative to the cylinder and arranged to cooperate with the first valve. The first valve comprises at least one air inlet opening communicating with a pressure air source and at least one air venting port communicating with the atmosphere. The second valve is arranged to selectively prevent communication between the at least one inlet opening and the recoil cushioning air volume while establishing communication between the at least one venting port and the recoil cushioning air volume when the cylinder is in its extreme forward position relative to the housing, and to selectively establish communication between the at least one inlet opening and the recoil cushioning air volume while preventing communication between the at least one venting port and the air volume when the cylinder is in its extreme rear position relative to the housing. This arrangement improves handling of the impact tool.

7 Claims, 4 Drawing Figures

VIBRATIONLESS IMPACT TOOL

BACKGROUND OF THE INVENTION

This invention relates to an impact tool comprising a housing, a cylinder axially movable in said housing, a hammer piston provided with pressurized fluid-operated reciprocable drive means arranged for reciprocably driving said hammer piston relative to said cylinder, a cushioning space for containing a recoil cushioning volume of air between the cylinder and the housing, and a pressure regulating means for controlling the supply and venting of air, to and from, respectively, the cushioning space and for balancing the pressure within the cushioning space relative to an actual forward feeding force applied to the housing in use of the tool.

An impact tool of the above type as disclosed in U.S. Pat. No. 3,727,700. This known tool, however, employs a vibration cushioning chamber which is continuously supplied with pressurized air and in which the air pressure is controlled by a spring biased relief valve mechanism. The opening pressure of the latter is determined by the degree of compression of the relief valve biasing spring, which in turn depends on the forward feeding force applied to the tool housing.

This type of pressure regulating means is, however, disadvantageous in that, in addition to the continuous air relief flow determined by the degree of compression of the relief valve biasing spring, it momentarily vents air to the atmosphere in order to avoid the build up of pressure peaks during recoil of the cylinder. Thus the above type of pressure regulating means does not permit the air in the cushioning chamber itself to be used as a resiliently deformable and, in use, deformed, spring means and thus itself, together with the cylinder and the housing, form a spring-mass vibration dampening system.

It is an object of the present invention to avoid or minimize one or more of the above disadvantages and to provide an impact tool with an improved pressure regulating means.

SUMMARY OF THE INVENTION

The present invention provides an impact tool comprising a housing (10), a cylinder (12) axially movable in the housing (10), a hammer piston (17) reciprocably driven by pressure fluid in the cylinder (12), a recoil cushioning space (27, 30) arranged between the cylinder (12) and the housing (10), and a pressure regulating means (26,38) for controlling the supply and venting of air to and from, respectively, the cushioning space (27,30) and for balancing the pressure within the cushioning space (27,30) relative to an actual forward feeding force applied to the housing (10) in use of the tool.

According to the present invention, the pressure regulating means (26,38) comprises a first part (26) located in fixed disposition relative to the housing (10) and a second part (38) located in a fixed disposition relative to the cylinder (12), the first and second parts (26,38) being formed and arranged so that changes in the relative positions therebetween corresponding to changes in the relative axial positions of the housing (10) and cylinder (12) controls the supply and venting of air, to and from the cushioning space (27-31), respectively.

In a tool of the present invention there can be obtained an improved damping by using a volume of air in the cushioning space itself as an additional spring means.

Further preferred features and advantages of the invention will appear from the following description given by way of example of a preferred embodiment illustrated with reference to the accompanying drawings.

DETAILED DESCRIPTION

Figure 1:
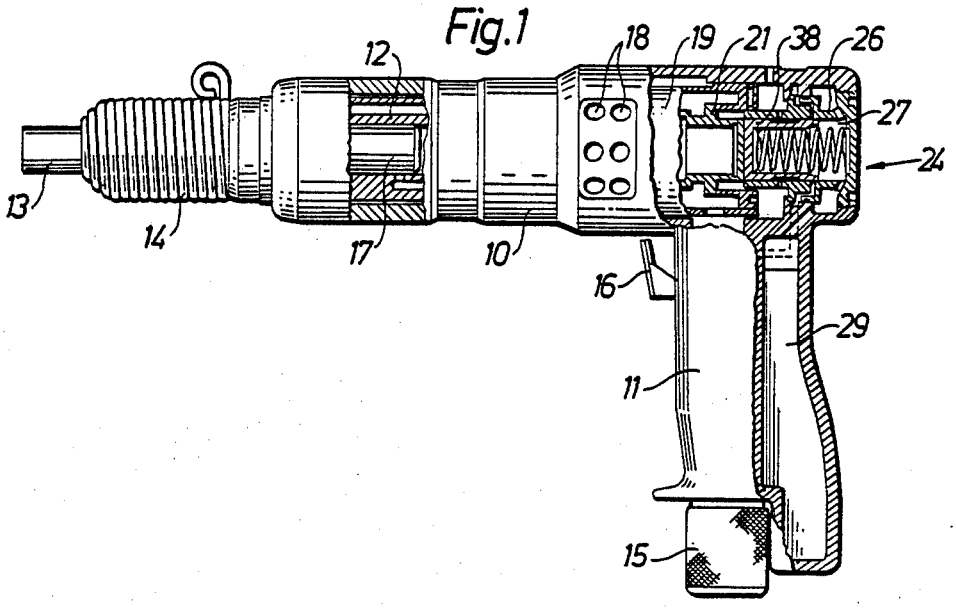
FIG. 1 is a partly sectioned side elevation of a pneumatic impact tool of the invention.

FIG. 1 shows a hand held riveting tool which is intended to be supported in one hand, in use thereof. The tool comprises a housing 10 which is formed with a pistol grip 11 and which guidedly supports an axially movable cylinder 12. At its forward end, the housing 10 is provided with a tool receiving opening (not shown) into which is fed the rear end of a rivet punch 13. The latter is axially secured to the cylinder 12 by means of a wire-type tool retainer 14.

At the lower end of the pistol grip 11, there is mounted a quick release coupling nipple 15 for connection of the tool to a pressurized air source. Within the pistol grip 11 there is lodged a throttle valve (not shown) which is operable by a trigger 16.

The impact mechanism of the tool shown in the drawings is of conventional design and does not constitute a part of the novel features of the present invention. Accordingly the impact mechanism will not be illustrated or described in any great detail. Briefly, the impact mechanism comprises a cylinder 12 and hammer piston 17 operated by pressurized air within said cylinder 12. The reciprocating movement of the hammer piston 17 is controlled by an air distribution valve in a conventional manner similar to that used in known impact mechanisms of this type. Exhaust air is vented to the atmosphere through outlet openings 18.

At its rear end, the cylinder 12 is provided with a rigid tubular extension 19 threadedly engaging an annular end closure 20. A generally cup shaped support member 21 is located within the tubular extension 19 coaxially with the cylinder 12. The support member 21 is kept in place by the end closure 20. Between the tubular extension 19 and the support member 21 there is formed the air inlet passage of the abovementioned impact mechanism which passage communicates with the downstream side of the throttle valve in the pistol grip 11 through an opening.

In the rear part of the housing 10, there is provided a damping unit 24 which comprises a rear end wall 25 and a tubular valve housing 26 formed integrally with the end wall 25 and extending coaxially with the cylinder 12 and the support member 21. The valve housing 26 defines a cylindrical valve chamber 27 into whose forward end the support member 21 is able to enter.

Adjacent the rear end wall 25, the valve housing 26 is provided with a number of radial openings 28 communicating with an annular chamber 30 in the housing 10. The chamber 30 is in turn maintained in continuous communication with a further chamber 29 in the pistol grip 11 via a passage 31 in the housing 10. The further chamber 29, the annular chamber 30 and the valve chamber 27 and their interconnecting passages 28, 31 together constitute a recoil cushioning space.

Close to its forward end, the valve housing 26 has a number of air vent ports 32 connecting the valve chamber 27 with a venting space 33 which surrounds the valve housing 26 and is connected to the atmosphere through outlet openings 34.

Between the air vent ports 32 and the radial openings 28, there is provided a number of air supply ports 35 which are connected, via passages 36 and 37 (illustrated in dash lines), to the main pressurized air supply passage of the tool upstream of the trigger (16) operated throttle valve.

Within the valve chamber 27, there is located a cup shaped piston-like valve member 38 disposed with its end wall 39 (see FIG. 4) in abutment with the rear end of the support member 21. A resilient biasing means in the form of a coil type compression spring 40 has one ene disposed inside the valve member 38 and its other end in abutment with the rear end wall 25 of the housing 10 so that the spring 40 biases the valve member 38, as well as the support member 21 and the cylinder 12 therethrough, in the forward feeding direction of the tool.

The valve member 38 is formed with an annular waist 42 defining, together with the valve housing 26 a control chamber therebetween. The waist 42 has opposed frusto-conical end portions 43 and 44 (see FIG. 4) which define with the valve housing 26 tapered end portions of the control chamber for providing a smoothly continuously variable ranges of opening and closing of the air supply and vent ports (35, 32) during reciprocation of the valve member (38) in order to accomplish an as accurate as possible pressure balancing in the valve chamber 27 and, in fact, in the entire recoil cushioning space. Within the annular waist 42 the valve member 38 is provided with two radial openings 46 through which the annular chamber defined between the annular waist 42 and the valve housing 26, communicates with the valve chamber 27.

Figure 4:
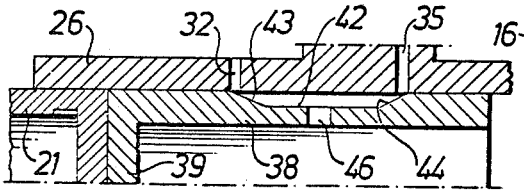
FIG. 4 is a further detail sectional view, on a still larger scale, of the pressure regulating means of FIGS. 1 to 3.

The width of the waist 42 (axially of the valve member 38) relative to the axial separation of the air supply ports 35 and the air vent ports 32 is selected to be such that an optimum regulation of the pressure within the recoil cushioning space is obtained. As shown in FIG. 4, the port locations (35, 32) and the width of the waist 42 are such that supply and drainage of air to the valve chamber 27 can take place simultaneously in an intermediate position of the valve member 28 as shown in FIG. 4.

Figure 2:
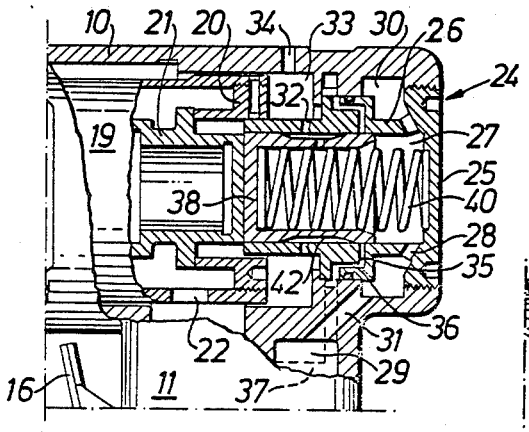
FIG. 2 is a partly sectioned detail side view on an enlarged scale, of the rear end portion of the tool shown in FIG. 1 in its rest position.
Figure 3:
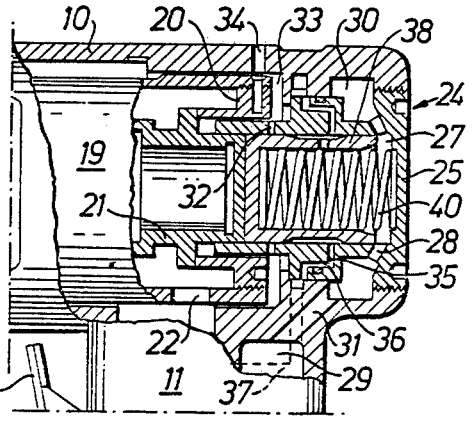
FIG. 3 is a corresponding view but with the cylinder and the pressure regulating means of the tool in their full load positions.

In use of the riveting tool the inlet nipple 15 is connected up to a pressurized air supply and pressurized air fed to the supply port 35 via the passages 36, 37. In the starting position of the tool, i.e. when no forward feeding force is applied on the tool housing 10, the cylinder 12 is kept in its forwardmost position relative to the housing 10, with respect to the forward feeding direction by means of the spring 40 acting between the rear end wall 25 of the housing 10 and the valve member 38. Since the latter continuously abuts against the support member 21, the forwardly directed biasing force exerted by the spring 40 is directly transferred to the cylinder 12. By pulling the trigger 16 pressurized air is then supplied to the impact mechanism. If, however, the rivet punch 13 is not applied to a rivet and no feeding force is exerted on the housing 10, the relative positions of the housing 10 and the cylinder 12 remain unchanged. This means that the air supply ports 35 are occluded by the valve member 38 and pressurized air is unable to pass into the valve chamber 27 via the annular waist 42 and radial openings 46 of the valve member 38. In this no-load position, illustrated in FIGS. 1 and 2, the air vent ports 32 are open to the waist 42, which means that the valve chamber 27 and the entire recoil cushioning space are vented to the atmosphere and pressure does not build up in the cushioning space.

If a normal operating force is applied to the housing 10 by an operator, a working position of the cylinder 12 relative to the housing 10 can be found in which the frusto-conical end portions 43 and 44 of the valve member waist 42, control opening and closing of the supply and drainage ports 35 and 32, respectively, in such a manner that the pressure within the cushioning space is continuously balanced relative to the actual feeding force acting on the housing, or more specifically, so that the force exerted by the cushioning space pressure on the valve member 38 together with the force exerted by the spring 40 thereon equal the force applied to the housing 10 by the operator.

If, however, the feeding or backing force on the housing 10 is too great, the valve member 38 is displaced to its rearmost or full-load position, in which the air vent ports 32 are completely occluded by the valve member 38 and the supply ports 35 are fully opened to the annular waist 42. This means that the full pressure of the pressurized air source is developed in the cushioning space.

The operational properties of the recoil cushioning arrangement of the above tool of the invention are characterized by an arcuate and continuous adjustment of the static cushioning volume pressure over a wide range of tool feeding forces and a very effective recoil and vibration absorption throughout the static pressure range of the cushioning space.

The outstanding dynamic force absorption properties of the cushioning arrangement of the invention are due to the use of a relatively large cushioning space. The total spring constant of the relatively large volume of air in the cushioning space and the spring 40 is preferably adapted with respect to the masses of the cylinder 12 and the housing 10 so that the resonant frequency of the system is considerably less than the vibration frequency of the impact mechanism. By using air supply and air vent ports 35 and 32, respectively, with a small total area, a restricted air flow to and from the cushioning space is obtained, in particular during those short rapid movements of the cylinder 12 induced by the recoil action of the impact mechanism. This means that the dynamic pressure variations are absorbed by the air volume in the cushioning space in a substantially elastic manner, the air volume forming the spring of a mass-spring-mass vibration dampening system in which the two masses are on the one hand the cylinder 12 and on the other hand the housing 10.

I claim:

1. A vibrationless pneumatic impact tool comprising:

a housing;

a cylinder axially displaceable in said housing;

a hammer piston reciprocably driven by pressure air in said cylinder;

a recoil cushioning air volume disposed between said housing and said cylinder;

a first valve means located in a fixed disposition relative to said housing;

a second valve means located in a fixed disposition relative to said cylinder and arranged to cooperate with said first valve means;

said first valve means comprising at least one air inlet opening communicating with a pressure air source and at least one air venting port communicating with the atmosphere;

said second valve means being arranged to selectively prevent communication between said at least one inlet opening and said air volume while establishing communication between said at least one venting port and said air volume when said cylinder is in its extreme forward position relative to said housing, and to selectively establish communication between said at least one inlet opening and said air volume while preventing communication between said at least one venting port and said air volume when said cylinder is in its extreme rear position relative to said housing.

2. The impact tool of claim 1, wherein:

said first valve means comprises a cylindrical chamber extending coaxially with said cylinder; and said second valve means comprises a tubular valve body disposed coaxially with and at the rear end of said cylinder.

3. The impact tool of claim 1, wherein said valve body comprises lands arranged for sealing cooperation with the walls of said cylindrical chamber and for covering and uncovering, respectively, said at least one air inlet opening and said at least one venting port, said lands comprising ramp means thereon for a successive covering and uncovering of said at least one air inlet opening and venting port.

4. The impact tool of claim 3, wherein said lands of said valve body are disposed relative to said at least one air inlet opening and to said at least one venting port such that when said cylinder occupies a certain position relative to said housing between its extreme forward and extreme rear positions both of said at least one air inlet opening and said at least one venting port are partly uncovered.

5. The impact tool of claim 3 or 4, wherein said lands are formed by two annular portions of said tubular valve body, said two annular portions being axially spaced by a waist portion having conically diverging ends defining said ramp means.

6. The impact tool of claim 2, wherein said valve body is disposed between said cylinder and said air volume; and is arranged to transfer the entire feeding force from said housing to said cylinder.

7. The impact tool of claim 1, wherein said second valve means continuously adjusts the static cushioning volume pressure of said recoil cushioning air volume.

* * * * *